US006275206B1

(12) United States Patent
Tsai et al.

(10) Patent No.: US 6,275,206 B1
(45) Date of Patent: Aug. 14, 2001

(54) BLOCK MAPPING BASED UP-SAMPLING METHOD AND APPARATUS FOR CONVERTING COLOR IMAGES

(75) Inventors: Ping-Sing Tsai, Gilbert; Tinku Acharya, Tempe, both of AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/272,751

(22) Filed: Mar. 17, 1999

(51) Int. Cl.[7] ..... G09G 3/36

(52) U.S. Cl. ..... 345/88; 345/150; 345/152; 345/153; 345/132; 345/154; 345/155; 345/100

(58) Field of Search ..... 345/88, 150, 152, 345/153, 154, 155, 132, 100

(56) References Cited

U.S. PATENT DOCUMENTS 5,416,496 * 5/1995 Wood ..... 345/102
5,745,093 * 4/1998 Tsuzuki et al. ..... 345/103
5,894,300 * 4/1999 Takizawa ..... 345/115
6,043,804 * 3/2000 Green ..... 345/153

* cited by examiner

*Primary Examiner*—Richard Hjerpe
*Assistant Examiner*—Ali Zamani
(74) *Attorney, Agent, or Firm*—Blakely, Sokoloff, Taylor & Zafman LLP

(57) ABSTRACT

A method is disclosed having the step of loading a register with a set of color pixel component values. The method also includes circularly shifting the register a predetermined number of times before outputting each value in the register to create a cell of color pixel component values suitable for display in a liquid crystal display. An apparatus for performing the method is also disclosed.

20 Claims, 4 Drawing Sheets

BLOCK MAPPING BASED UP-SAMPLING METHOD AND APPARATUS FOR CONVERTING COLOR IMAGES

FIELD OF THE INVENTION

This invention is related to the field of use of image processing. More particularly, this invention is directed to a method and apparatus for converting color images for liquid crystal display (LCD).

BACKGROUND

Video and still image capture using a digital camera has become very prevalent. Video capture may be used for such applications as video conferencing, video editing, and distributed video training. Still image capture with a digital camera may be used for such applications as photo albums, photo editing, and compositing. Many components of hardware and software need to work seamlessly to both get the video data (also referred to as a video "stream") or the still image data from the hardware through the various layers of software on the personal computer (PC) and made visible on a display medium such as a monitor.

In many digital cameras, video or still image data is first stored on a local storage device in the image capture system as the digital camera is not tethered to the PC at all times (e.g., the user goes to a park to take pictures). Then, when the user returns to the location of the user's PC, the data is then transferred to the PC when the user connects the digital camera to the PC. It is often useful to provide a way to preview captured video or still images before the data is transferred to the PC, as the process of image transfer can be time consuming. This allows the user to be selective in what data the user transfers to the PC or leaves on the digital camera.

To provide a preview mechanism, the digital camera may either provide a viewfinder or a liquid crystal display (LCD). Many digital cameras include both, as the viewfinder offers more privacy of what is being filmed (e.g., only the user can see what is being filmed or being played back) and does not consume as much power as a LCD display while a LCD allows the user to operate the digital camera more easily when viewing playback (e.g., the user can control the fast forwarding, reverse, and pausing of the video without trying to look into the viewfinder at the same time) or allows more flexibility in the positioning of the camera for the capturing of a scene (e.g., the user can hold the camera above the user when the user is behind a crowd, and use the LCD to see what is being captured).

Typically, digital cameras capture each frame of a video or each still image in an 8-bit RGGB (red, green, green, and blue) format (also known as a Bayer pattern) and this converts it into a 24-bit RGB (red, green, and blue) format. In the 24-bit RGB image format, each pixel in the image is represented by the combination of an 8-bit value of red, an 8-bit value of green, and an 8-bit value of blue. Neither format is not suitable for display on an LCD, which uses a pattern of individual color components to form each pixel, so the images must be converted to a suitable LCD format. An exemplary format for use in LCD's is an 8-bit RGB diagonal mosaic, where each pixel is composed from a square of 4 individual component values that is viewed by the human eye as one single pixel.

One method used to perform the necessary image conversion first up-samples the 24-bit RGB format captured image to the same size as required by the display, and then maps the data to a particular pattern, such as the 8-bit RGB diagonal mosaic. During the mapping process, the up-sampled image is decimated (that is, values in the up-sampled image are thrown out).

FIG. 1 illustrates the current two-step process for converting a 24-bit RGB format image to a 8-bit RGB diagonal mosaic. Where the image data for a 24-bit image data 50 is composed of three separate matrices of 8-bit color data, one for each of the red 52, green 54, and blue 56 components. In FIG. 1, the 24-bit RGB image is an image that is 3 pixels wide by 3 pixels tall. Red pixel matrix 52 thus contains 9 red component values (at a size of 8-bits for each value), one for each of the 9 pixels in the image. Similarly, green and blue pixel matrices 54 and 56 also contain the green and blue component values, respectively, for the 9 pixels in the image.

The first step in the prior art method for converting a 24-bit RGB image to a format suitable for LCD display is to up-sample the 24-bit RGB image to an image size that is twice as large as the original image size. Thus, the 3×3 matrices are up-sampled to 6×6 matrices. Up-sampling may be performed in several ways. For example, red component values R(0,0) [where, the (i, j) coordinates are the (row, column) coordinates], R(0,1), R(1,0), and R(1,1) in red pixel matrix 62 may all be the same value as the red component value R(0,0) in red pixel matrix 52. Alternatively, red component values in the up-sampled matrix may be interpolated, where red component value R(0,1) in red pixel matrix 62 may be an average of the red component values R(0,0) and R(0,1) in red pixel matrix 52. Similarly, green component value G(0,1) in green pixel matrix 64 may be an average of the green component values G(0,0) and G(0,1) in green pixel matrix 54.

The second step in the conversion process is to perform a decimate mapping of the up-sampled matrices to form the 8-bit RGB diagonal mosaic patterned image suitable for display by the LCD. For example, in LCD matrix 70, pixel (0,0) is composed of four 8-bit values (R, B, B, and G). Similarly, for pixel (0,1), a different pattern of four 8-bit values (G, R, R, and B) make up the pixel. For pixel (0,0), the red component comes from red component value R(0,0) in red pixel matrix 62, the green component comes from green component value G(1,1) in green pixel matrix 64, and the blue components comes from blue component values B(1,0) and B(0,1) in blue pixel matrix 66. The component values that are not used are ignored.

The process as illustrated in FIG. 1 is wasteful as interpolation error is introduced during the up-sampling step. In addition, during the decimating step, two-thirds of the up-sampled image data is thrown-away. Computational resources are consumed by performing the up-sampling and decimation steps, and storage resources are also consumed for the up-sampled data.

SUMMARY

A method is disclosed having the step of loading a register with a set of color pixel component values. The method also circularly shifting the register a predetermined number of times before outputting each value in the register to create a cell of color pixel component values suitable for display in a liquid crystal display. An apparatus for performing the method is also disclosed.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention provides a system for a block mapping based up-sampling process to up-sample a 24-bit RGB image to a higher resolution 8-bit RGB diagonal mosaic type image in one conversion. By using one step to perform the conversion process, computational and storage resources are saved by not having to perform additional steps or store intermediary data.

In one embodiment, the block mapping up-sampling system is based on a lay-out of a specific diagonal mosaic-type pattern. In other embodiments, other lay-outs of patterns may be used and adapted to.

Figure 1:
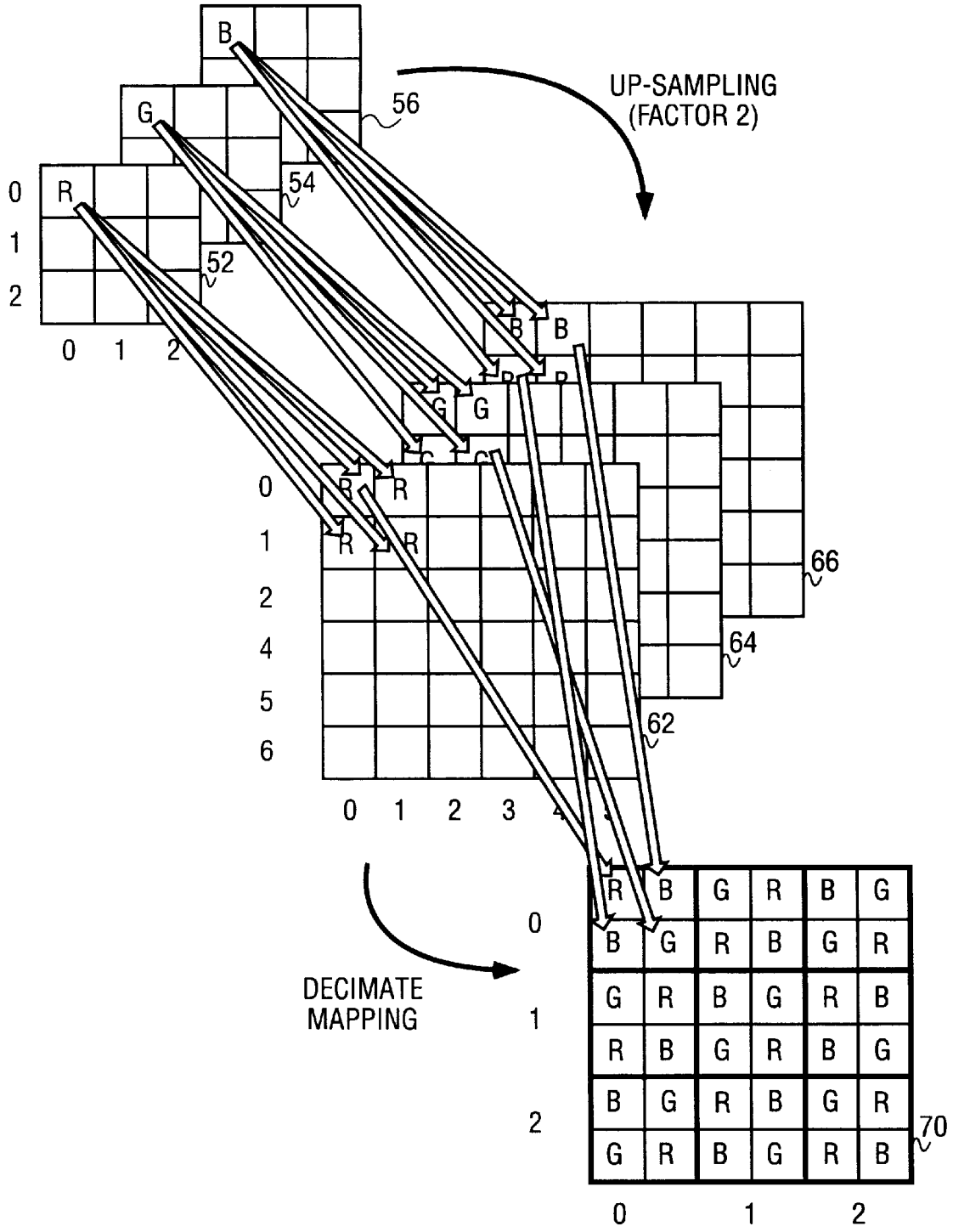
FIG. 1 (PRIOR ART)
FIG. 1 is a diagram that illustrates a prior-art conversion of a 24-bit RGB image to an image format suitable for display on a LCD.
Figure 2:
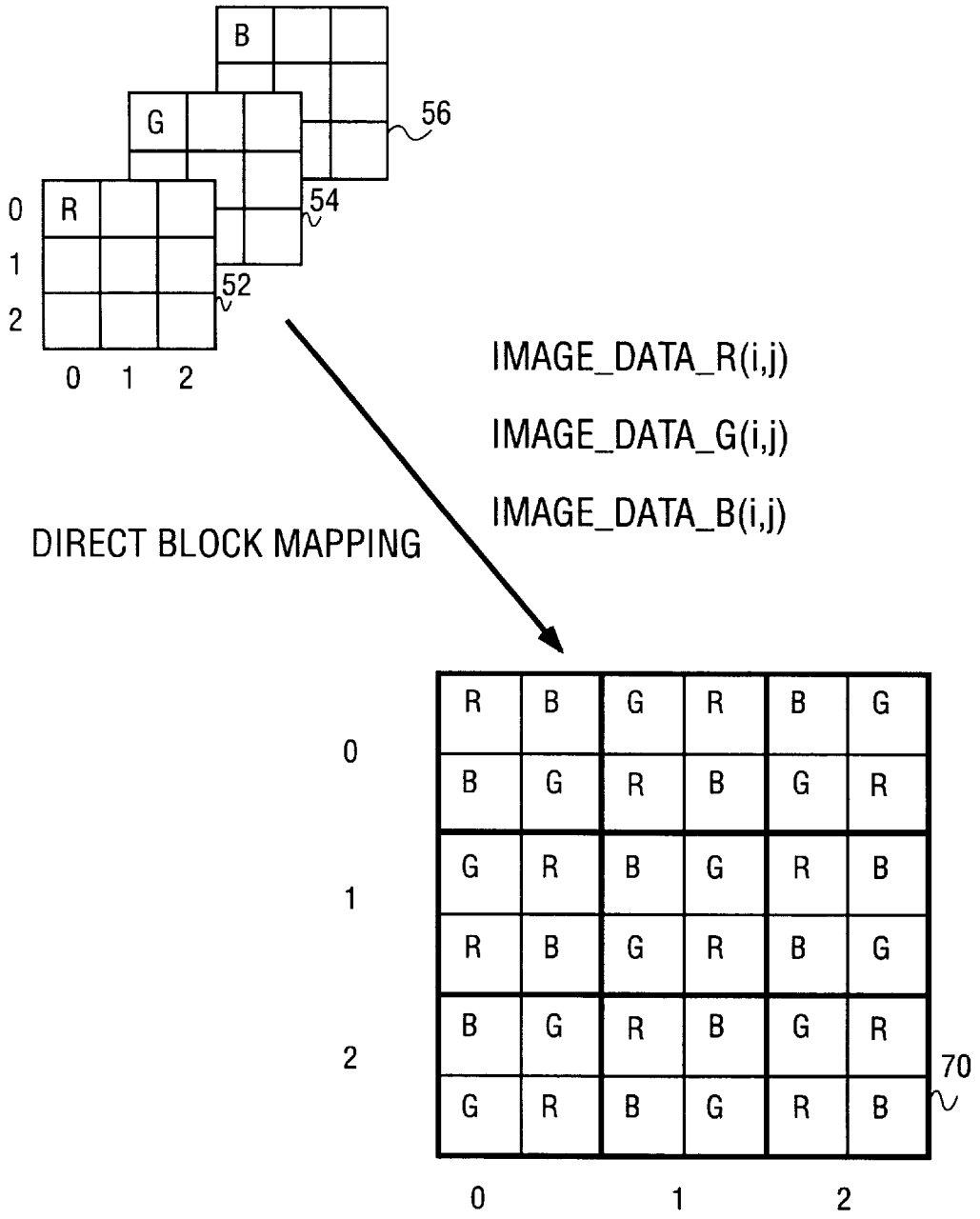
FIG. 2 is a diagram that illustrates a direct block mapping conversion of a 24-bit RGB image to an image format suitable for display on a LCD in accordance with one embodiment of the present invention.

FIG. 2 is a block diagram illustrating the process for converting a 24-bit RGB image to a higher resolution 8-bit RGB diagonal mosaic type image in one conversion. In FIG. 2, the original 24-bit RGB image is made up of three matrices-one red pixel matrix 52, one green pixel matrix 54, and one blue pixel matrix 56. The direct block mapping process re-maps the component values in these matrices into a specific diagonal mosaic-type pattern as in LCD matrix 70. This process avoids the two-step process of first up-sampling the three matrices into three larger matrices, and then having to perform decimate mapping to throw away unused information to form the final matrix used to display in the LCD.

Figure 3:
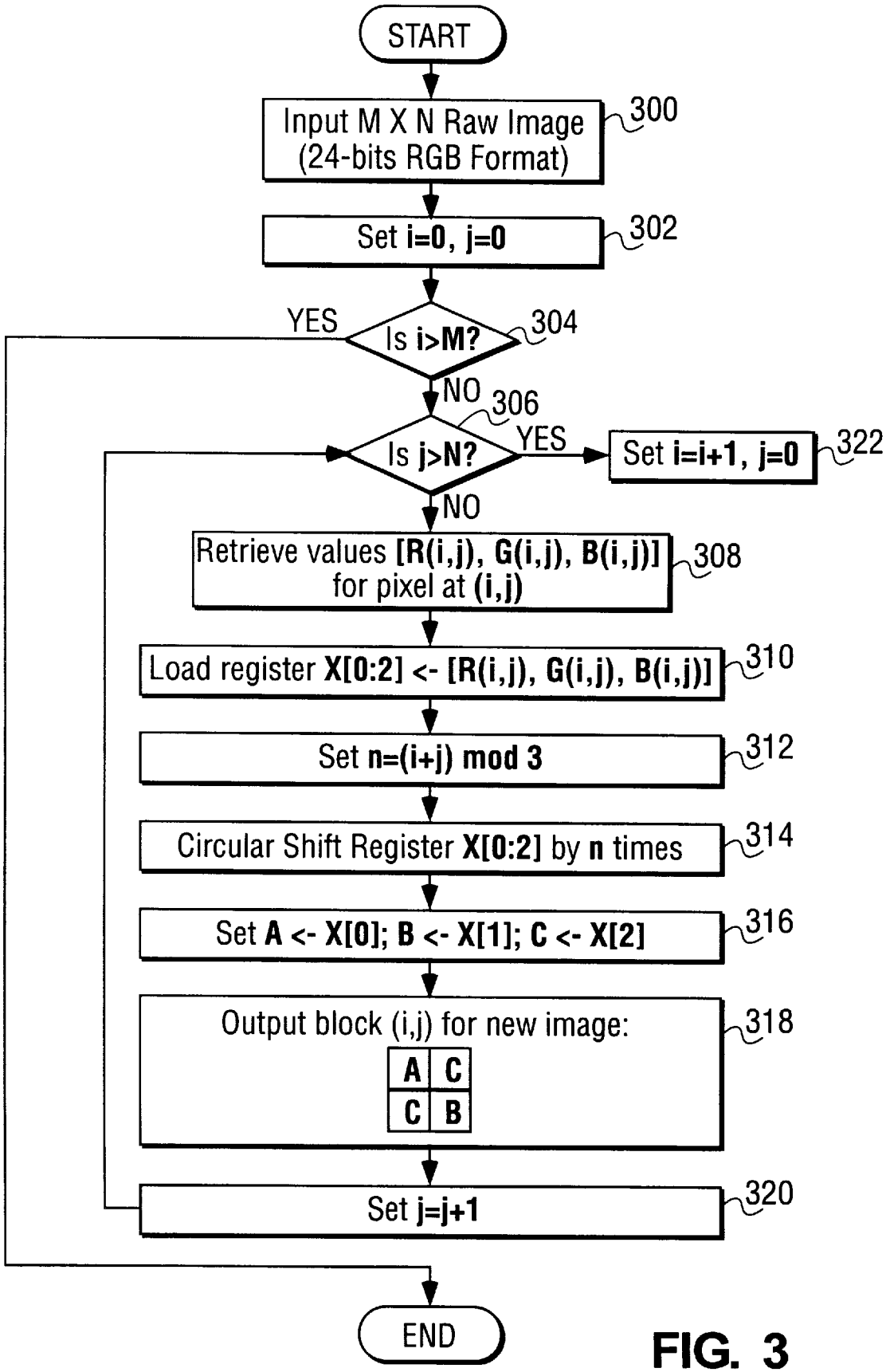
FIG. 3 is a flow diagram of a direct block mapping conversion process performed in accordance with one embodiment of the present invention.

FIG. 3 is a flow diagram illustrating a process for image conversion in accordance with one embodiment of the present invention. The process begins with block 300, where an M×N raw 24-bit RGB image is input to the image conversion system. Then, in block 302, the system is reset by resetting two counters, i and j, to zero. In one embodiment, the value in counter i represents the row being addressed, while the value in counter j represents the column being addressed.

In block 304, the value in counter i is compared to M, and if M is less than or equal to the value in counter i, then the process continues with block 306, where the value in counter j is compared to N. If the value in counter j is less than or equal to N, then the process continues with block 308. Otherwise, the process continues with block 322. Blocks 304 and 306 are to check for out-of-bounds cases where the values of counters i and j are larger than M and N, respectively. This is to prevent the operations in blocks 308–320 from being executed in out-of-bounds cases as it would not make sense to try and access/process a pixel with a location outside of M or N.

In block 308, the values of the individual color components for each of the color components at position (i,j) are retrieved from the 24-bit RGB image. For example, where the values in counters i and j are 0 and 1, respectively, the red pixel value at position R(0,1) of red pixel matrix 52; the green pixel value at position G(0,1) of green pixel matrix 54; and the blue pixel value at position B(0,1) of blue pixel matrix 56 are retrieved. Operation the continues with block 310.

In block 310, a register X having three locations for storing three pixel values is loaded with the values that were retrieved in block 308. In one embodiment, each location has a size of 8 bits, which is the size of the pixel retrieved from the raw image. X[0] (position 0 in register X) is loaded with the red pixel value, X[1] (position 1 in register X) is loaded with the green pixel value, and X[2] (position 2 in register X) is loaded with the blue pixel value. In the example discussed above, X[0] would be loaded with the red pixel value at position R(0,1) of red pixel matrix 52; X[1] would be loaded with the green pixel value at position G(0,1) of green pixel matrix 54; and X[2] would be loaded with the blue pixel value at position B(0,1) of blue pixel matrix 56. After register X is loaded, operation continues with block 312.

In block 312, a variable n is set to be addition of the values contained in counters i and j, and then run through a modulus of 3. For example, if the value in counter i is 0, and the value in counter j is 1, then the sum of i and j will be 1, and modulus 3 of one is one. Thus, n is set to 1.

In block 314, register X is left shifted circularly by n times. For example, if n is equal to one, the pixel value in X[0] is circularly moved to the left by one position (specifically, the value in X[0] becomes the value in X[2], the value in X[1] becomes the value in X[0], and the value in X[2] becomes the value in X[1]). Thus, after shifting, X[0] contains the green pixel value at position G(0,1) of green pixel matrix 54; X[1] contains the blue pixel value at position B(0,1) of blue pixel matrix 56; and, X[2] contains the red pixel value at position R(0,1) of red pixel matrix 52. Operation then continues with block 316.

In block 316, variable A is set to the value contained in X[0], variable B is set to the value contained in X[1], and variable C is set to the value contained in X[2]. Continuing with the example above, where i and j are 0 and 1, respectively, variable A is set to contain the green pixel value at position G(0,1) of green pixel matrix 54, variable B is set to contain the blue pixel value at position B(0,1) of blue pixel matrix 56, and variable C is set to contain the red pixel value at position R(0,1) of red pixel matrix 52. Operation then continues with block 318.

In block 318, a new cell for the image to be displayed on the LCD display is output with the appropriate pixel values in the corresponding blocks. Thus, for example, the output block for i and j equal to 0 and 1, respectively would be:

| | |
|---|---|
| $A = G(0, 1)$ | $C = R(0, 1)$ |
| $C = R(0, 1)$ | $B = B(0, 1)$ |

In block 320, the value of counter j would be incremented by 1, and operation would return to block 306.

Returning to the discussion of block 306, if the value in counter j is greater than N, then operation would continue with block 322, where the value in counter j is reset to 0, and the value in counter i is incremented by 1.

Figure 4:
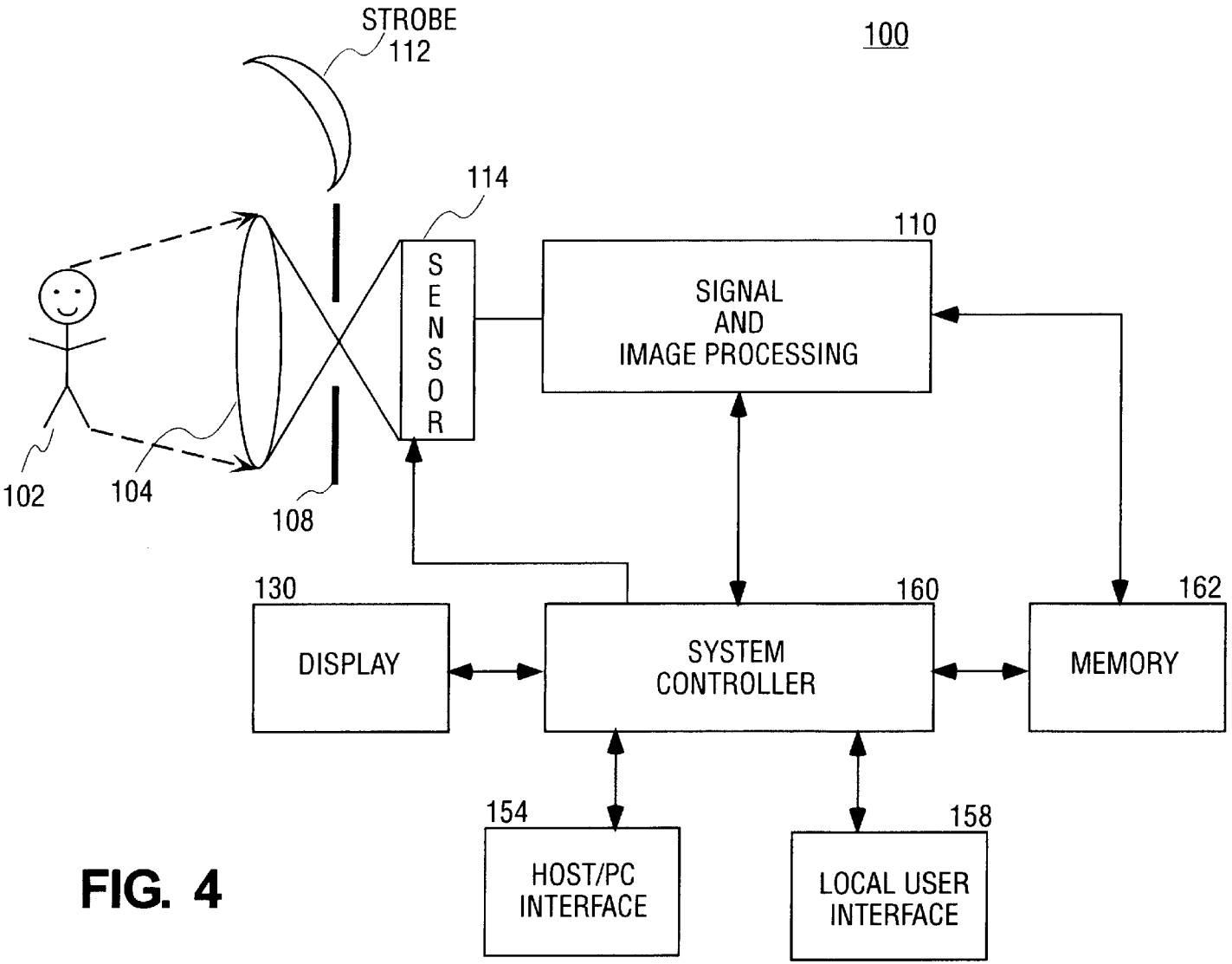
FIG. 4 is a block diagram of an imaging system configured in accordance with one embodiment of the present invention.

An embodiment of the invention included in an imaging system 100 is shown as a logical block diagram in FIG. 4. Imaging system 100 includes a number of conventional elements, such as an optical system having a lens 104 and aperture 108 that is exposed to the incident light reflected from a scene or object 102. The optical system properly channels the incident light towards a sensor array 114 that generates sensor signals in response to an image of object 102 being formed on sensor array 114. The various control signals used in the operation of sensor array 114, such as a RESET signal, a SAMPLE signal and an ADDRESS signal is generated by a system controller 160. System controller 160 may include a microcontroller or a processor with input/output (I/O) interfaces that generates the control signals in response to instructions stored in a memory such as a memory 162. In one embodiment, memory 162 which stores code/program instructions and data includes both a non-volatile programmable memory component and a volatile memory component. System controller 160 also acts in response to user input via a local user interface 158 (as when a user pushes a button or turns a knob of system 100) or a host/PC interface 154 to manage the operation of imaging system 100. The functions of controller 160 may also be implemented as a logic circuit that is tailored to generate the control signals with proper timing. Host/PC interface 154 may also transfer the captured image data to an image processing and/or viewing system such as a computer separate from imaging system 100.

Imaging system 100 contains a display 130 for displaying the captured image data. In one embodiment, imaging system 100 is a portable digital camera with display 130 as a LCD for showing the image data captured. As discussed above, the LCD requires that the image data sent to it to be displayed is in a format such as the 8-bit RGB diagonal mosaic.

To obtain images, a signal and image processing block 110 is provided in which hardware and software operates according to image processing methodologies to generate captured image data in response to receiving the sensor signals. The captured image data is then stored in memory 162 as in the raw 24-bit RGB image format. In addition to storing this image data in memory 162, optional storage devices (not shown) can be used aboard system 100 for storing the captured image data. Such local storage devices may include a removable memory card.

To display images on display 130, system controller 160 processes the raw 24-bit RGB image as discussed above to arrive at the 8-bit RGB diagonal mosaic format. The processed image data is stored in memory 162 for access by display 130 or may be sent to display 130 directly after processing for display.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method comprising:

loading a register with a set of color pixel component values wherein loading the register with the set of color pixel component values includes retrieving the set of color pixel component values using a set of coordinates;

circularly shifting the register a predetermined number of times by a modulus of a sum of the set of coordinates by a modulus number; and, outputting each value in the register to create a cell of color pixel component values suitable for display in a liquid crystal display.

2. The method of claim 1, wherein loading the register with the set of color pixel component values includes loading a red pixel component value, a green pixel component value, and a blue pixel component value in the register.

3. The method of claim 1, wherein loading the register with the set of color pixel component values includes loading each color pixel component value in the set of color pixel component values from a corresponding color matrix into the register.

4. The method of claim 1, wherein circularly shifting the register by the modulus of the sum of the set of coordinate by the modulus number includes circularly shifting the register by the modulus of the sum of the set of coordinates by 3.

5. The method of claim 1, wherein outputting each value in said register to create the cell of color pixel component values includes outputting a two pixel value high by two pixel value wide matrix.

6. An article comprising a computer readable medium having instructions stored thereon, which when executed, causes:

retrieval of a set of color pixel component values using a set of coordinates;

loading of a register with the set of color pixel component values;

circularly shifting of the register a predetermined number of times by a modulus of a sum of the set of coordinates by a modulus number; and, outputting of each value in said register to create a cell of color pixel component values suitable for display in a liquid crystal display.

7. The article of claim 6, wherein the computer readable medium further having instructions stored thereon, which when executed, causes:

loading of a red pixel component value, a green pixel component value, and a blue pixel component value in the register.

8. The article of claim 6, wherein the computer readable medium further having instructions stored thereon, which when executed, causes:

loading of each color pixel component value in the first set of color pixel component values from a corresponding color matrix in the register.

9. The article of claim 6, wherein the computer readable medium further having instructions stored thereon, which when executed, causes:

circularly shifting of the register by the modulus of the sum of the set of coordinates by 3.

10. The article of claim 6, wherein the computer readable medium further having instructions stored thereon, which when executed, causes:

output of a two pixel value high by two pixel value wide matrix.

11. An apparatus comprising:

a register having a set of color pixel component values stored therein wherein the set of color pixel component values have an associated set of coordinates;

a controller coupled to the register configured to circularly shift the register a predetermined number of times by a modulus of a sum of the set of coordinates by a modulus number; and, an output circuit coupled to the register to output each value in the register to create a cell of color pixel component values suitable for display in a liquid crystal display.

12. The apparatus of claim 11, wherein the first set of color pixel components include a red pixel component value, a green pixel component value, and a blue pixel component value.

13. The apparatus of claim 11, wherein each color pixel component value in the set of color pixel component values is from a corresponding color matrix into the register.

14. The apparatus of claim 11, wherein the controller is configured to circularly shift the register by the modulus of the sum of the set of coordinates by 3.

15. The apparatus of claim 11, the output circuit is configured to output a two pixel value high by two pixel value wide matrix.

16. An apparatus comprising:

means for storing a set of color pixel component values wherein the set of color pixel component values have an associated set of coordinates;

means for circularly shifting the storing means a predetermined number of times by a modulus of a sum of the set of coordinates by a modulus number;

means for outputting each value in the storing means to create a cell of color pixel component values suitable for display in a liquid crystal display.

17. The apparatus of claim 16, wherein the first set of color pixel components include a red pixel component value, a green pixel component value, and a blue pixel component value.

18. The apparatus of claim 16, wherein each color pixel component value in the set of color pixel component values is from a corresponding color matrix into the storing means.

19. The apparatus of claim 16, wherein the circularly shifting means is configured to circularly shift the storing means by the modulus of the sum of the set of coordinates by 3.

20. The apparatus of claim 16, the outputting means is configured to output a two pixel value high by two pixel value wide matrix.

* * * * *